US010848845B2

(12) United States Patent
Ye

(10) Patent No.: US 10,848,845 B2
(45) Date of Patent: Nov. 24, 2020

(54) MICROPHONE WITH MECHANICAL SWITCH FUNCTION

(71) Applicants: ZILLTEK TECHNOLOGY (SHANGHAI) CORP., Shanghai (CN); ZILLTEK TECHNOLOGY CORP., Hsinchu (TW)

(72) Inventor: Jinghua Ye, Shanghai (CN)

(73) Assignee: ZILLTEK TECHNOLOGY (SHANGHAI) CORP., Shanghai (CN)

( * ) Notice: Subject to any disclaimer, the term of this patent is extended or adjusted under 35 U.S.C. 154(b) by 37 days.

(21) Appl. No.: 16/509,703

(22) Filed: Jul. 12, 2019

(65) Prior Publication Data

US 2020/0228887 A1 Jul. 16, 2020

(30) Foreign Application Priority Data

Jan. 11, 2019 (CN) ..... 2019 1 0027949

(51) Int. Cl.

| | |
|---|---|
| ***H04R 1/04*** | (2006.01) |
| ***H04R 3/00*** | (2006.01) |
| ***H04R 19/04*** | (2006.01) |
| ***H01H 9/02*** | (2006.01) |

(52) U.S. Cl.

CPC ..... *H04R 1/04* (2013.01); *H01H 9/02* (2013.01); *H04R 3/00* (2013.01); *H04R 19/04* (2013.01); *H01H 2239/048* (2013.01); *H04R 2201/003* (2013.01)

(58) Field of Classification Search

CPC . H04R 1/04; H04R 3/00; H04R 19/04; H04R 2201/003; H01H 9/02; H01H 2239/048

See application file for complete search history.

(56) References Cited

U.S. PATENT DOCUMENTS

| | | | | |
|---|---|---|---|---|
| 2009/0243058 | A1* | 10/2009 | Shirasaka | H04R 1/06 257/670 |
| 2016/0134973 | A1* | 5/2016 | Oliaei | H04R 17/02 381/114 |
| 2016/0264399 | A1* | 9/2016 | Cheng | H04R 1/06 |
| 2017/0369305 | A1* | 12/2017 | Suvanto | B81B 7/008 |
| 2018/0115810 | A1* | 4/2018 | Zhang | H04R 19/04 |
| 2019/0182605 | A1* | 6/2019 | Morita | H04R 19/04 |

* cited by examiner

*Primary Examiner* — David L Ton

(74) *Attorney, Agent, or Firm* — Andrew F. Young, Esq.; Nolte Lackenbach Siegel

(57) ABSTRACT

The present invention relates to a microphone, and more particularly, to a microphone with a mechanical switch function. A microphone with a mechanical switch function according to the present invention comprises a microphone body, wherein the microphone body comprises a circuit substrate above which a metal cover is disposed, an acoustic cavity formed by the metal cover and the circuit substrate; and a metal elastic piece, wherein a gap is formed between the metal elastic piece and the metal cover, and the metal elastic piece electrically contacts with the metal cover under an effect of a pressing force. By adopting the above-mentioned technical solutions, the present invention provides a microphone with functions of a mechanical switch, and the new type of microphone occupies less space, has a lower cost and is convenient to use.

9 Claims, 2 Drawing Sheets

MICROPHONE WITH MECHANICAL SWITCH FUNCTION

CROSS-REFERENCE TO RELATED APPLICATIONS

The present application claims priority to and the benefit of Chinese Patent Application No. 201910027949.3, filed on Jan. 11, 2019, the entire content of which is incorporated herein by reference.

FIGURE SELECTED FOR PUBLICATION

FIG. 1.

BACKGROUND OF THE INVENTION

1. Field of the Invention

The invention relates to the field of microphone, and more particularly, to a microphone with a mechanical switch function.

2. Description of the Related Art

The MEMS (Micro Electrical-Mechanical Systems) microphones are produced by using the MEMS technology. Of note, a diaphragm and a backplate are essential components of the MEMS microphone. Moreover, the diagram and the backplate together form a capacitor and are integrated in a silicon wafer, converting a sound signal into an electrical signal.

In recent years, electronic products, such as driven-by-wire headphones and bluetooth headsets, are becoming compact due to the development of science and technology. In addition, there are higher demands for lighter and thinner products, so efforts have been made to reduce the packaging size of the MEMS microphone. And such trend will continue into the future. Although electronic products become smaller in size, microphone and a device switch still needs to be separated from each other. It has to be recognized that such a structure may meet the basic requirements in use, however, its design is not satisfactory, that is, it has complicated structure, and many components are involved during the manufacture of the products, hence high cost are inevitable. Moreover, humid weather may also lead to the corrosion of metal components in the interior of the switch, such that contact failure may occur when in use.

SUMMARY OF THE INVENTION

The technical problem in this invention is to provide a microphone with a mechanical switch function. This type of microphone may function as a switch, has a simple structure and is easy to operate. To solve the above-mentioned technical problem, the invention provides a microphone with a mechanical switch function, comprising: a microphone body, wherein the microphone body comprises a circuit substrate above which a metal cover is disposed, and an acoustic cavity formed by the metal cover and the circuit substrate;

further comprising: a metal elastic piece, wherein a gap is formed between the metal elastic piece and the metal cover, and the metal elastic piece electrically contacts with the metal cover under an effect of a pressing force.

Preferably, a metal cover cap is sleeved outside of the metal cover, and at least one surface of the metal cover cap is made of an elastic material which functions as the metal elastic piece.

Preferably, the metal elastic piece comprises a mounting portion that is insulated from the metal cover cap.

Preferably, an acoustic through-hole is disposed on the circuit substrate.

Preferably, the metal elastic piece comprises an arc-shaped surface, a concave face of the arc-shaped surface is arranged to face the metal cover, to form the gap.

The metal elastic piece further comprises a mounting frame, wherein a buckle is disposed on a top of the mounting frame, a mounting portion of the metal elastic piece is provided with a connection portion fitting with the buckle, and the mounting frame is arranged on the circuit substrate.

Preferably, the metal elastic piece is an elastic metal cover which is disposed outside the metal cover, and a gap is formed between the elastic metal cover and the metal cover, and the gap is in the range of 0.03 to 0.07 mm.

Preferably, the elastic metal cover is mounted on the circuit substrate, and an enclosed space is formed by the elastic metal cover and the circuit substrate.

The technical solutions adopted in the present invention have the follow beneficial effects: such an integrated structure has the advantages of thin product, simple structure, strong stability and small occupancy. Moreover, it is low in cost, such that it may be produced for a wide range of applications. It should be mentioned that such microphone not only has the switch function, but also has a microphone function. In addition, it has a beautiful appearance, making the customer more satisfied.

BRIEF DESCRIPTION OF THE DRAWINGS

The accompanying drawings, together with the specification, illustrate exemplary embodiments of the present disclosure, and, together with the description, serve to explain the principles of the present invention.

DETAILED DESCRIPTION

Hereinafter, two exemplary embodiments according to the present disclosure will be described with reference to the accompanying drawings. It should be noted that unless otherwise defined, the relative arrangements of the components and steps, numerical expressions and numerical values set forth in these two embodiments are not intended to limit the scope of the invention.

The following description of at least one exemplary embodiment is merely illustrative, and will be never intended to limit the invention and the application thereof.

Techniques and devices known to those of ordinary skilled in the relevant art may not be discussed in detail, however, all the techniques and devices, where appropriate, should be construed as a part of the specification.

In all of the examples shown and discussed herein, any specific values are to be construed as illustrative and not as a limitation. Thus, other examples of the exemplary embodiments may have different values.

Figure 1:
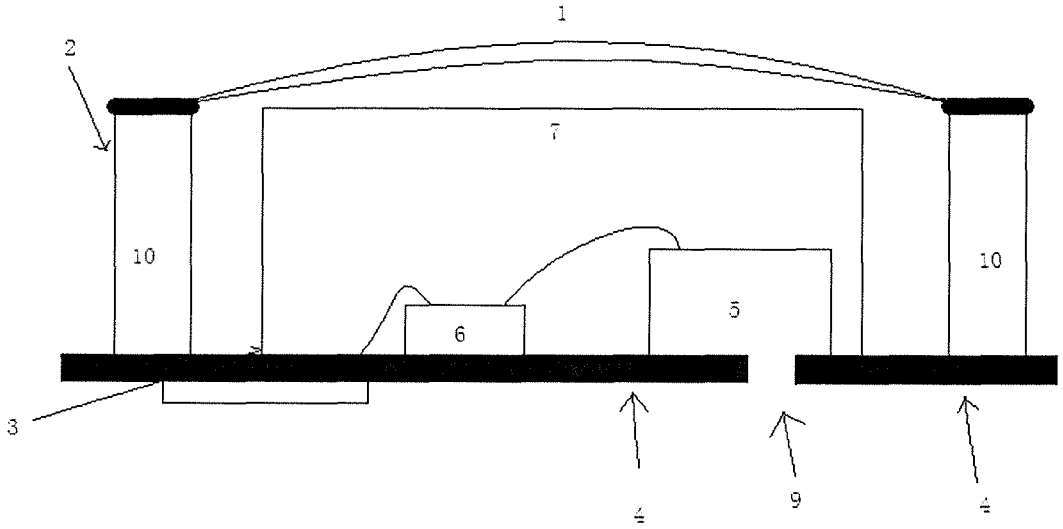
FIG. 1 is a schematic view of the main structure of the present invention and a first embodiment thereof.

Referring to FIG. 1, in a first embodiment, a microphone with a mechanical switch function comprises a microphone body, wherein the microphone body comprises a circuit substrate 4, a metal cover 7 is disposed above the circuit substrate 4, the metal cover 7 has a thickness of 0.1 mm, and an acoustic cavity is formed by the metal cover 7 and the circuit substrate 4; and a metal elastic piece 1 is disposed over the metal cover 7, and a gap is formed between the metal elastic piece and the metal cover, the metal elastic piece 1 electrically contacts with the metal cover 7 under an effect of a pressing force. It should be noted that a metal cover cap 10 is sleeved outside of the metal cover 7, and at least one surface of the metal cover cap 10 is made of an elastic material which functions as the metal elastic piece 1. The metal elastic piece 1 comprises a mounting portion that is insulated from the metal cover cap 10. The metal elastic piece 1 further comprises a mounting frame, wherein a buckle is disposed on a top of the mounting frame for connecting to the metal cover cap 10, a mounting portion of the metal elastic piece 1 is provided with a connection portion fitting with the buckle, and the metal cover cap 10 is arranged on the circuit substrate 4. Two ends of the metal elastic piece 1 are connected to an insulating material on the metal cover cap 10, and the metal cover cap has a thickness of 0.25 mm. The metal cover cap 10 is disposed on the circuit substrate 4, an end point connected by the metal cover cap 10 and the circuit substrate 4 is a power supply solder joint 2. The metal elastic piece 1 comprises an arc-shaped surface, a concave face of the arc-shaped surface is arranged to face the metal cover 7, to form the gap. An acoustic through-hole is disposed on the circuit substrate 4.

When the metal elastic piece 1 electrically contacts with the metal cover 7 under an effect of a pressing force, a sound test will be implemented: the tester sends out sound towards the acoustic through-hole, and the acoustic through-hole receives the sound from the tester, wherein sound signals received by a microphone chip may be all the sound signals received by the microphone acoustic through-hole during some time, and this set of sound signals may contain one or more signal signals. The process is implemented as follows:

As a preferred embodiment, the package structure of the present invention further comprises a MEMS chip 5, a ASIC chip 6 disposed in an enclosed space of the metal cover 7, wherein the MEMS chip 5 a transducer that functions to convert a sound signal into an electrical signal, and the transducer is fabricated by using the MEMS (Micro-electromechanical Systems) process. ASIC chip 6 is used to subsequently process the electrical signal output from the MEMS chip 5. The MEMS chip 5 and the ASIC chip 6 may be connected to the circuit substrate 4 by solder ball welding or bonding; moreover, the mounting may be performed by any mounting technologies that are known to those skilled in the art, and the MEMS chip 5 is electrically connected with the ASIC chip 5 via leads to achieve the signal transmission. The MEMS chip 5 is connected with the circuit on the circuit substrate 4 through wires. The ASIC chip 6 is connected with the circuit on the circuit substrate 4 through wires.

It should be noted that the package structure of the present invention further comprises a lower sound bore disposed on the circuit substrate 4. when pressing the switch, sound from the outside will transmit into the interior of the package structure through the lower sound bore, and impacts on the MEMS chip 5; the MEMS chip 5 will then converts the received sound signal into a corresponding electrical signal, and the electrical signal will be transmitted to the ASIC chip 6 through wires to facilitate the recognition and processing of the electrical signals executed by the ASIC chip 6. The aperture of the low sound bore can be adjusted according to the requirements of those skilled in the art. The lower sound bore microphone places the acoustic sensor MEMS chip 5 directly on the sound bore, while such an arrangement may make a front chamber become smaller, which in turn leads to an increase in a center frequency of the resonance. Since the resonance is always in the high frequency part of the audio-frequency band, the increased resonance makes the frequency response becomes flatter, such that sensitivity of the acoustic sensor MEMS chip 5 will be enhanced.

Figure 2:
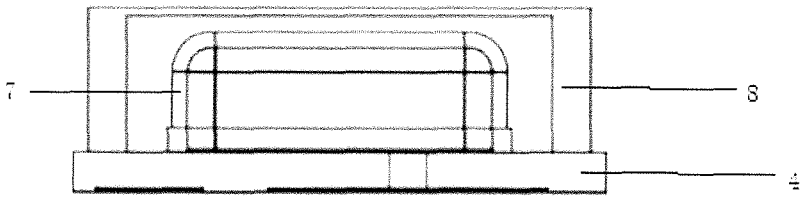
FIG. 2 is a schematic view of a plane structure of a second embodiment of the present invention.
Figure 3:
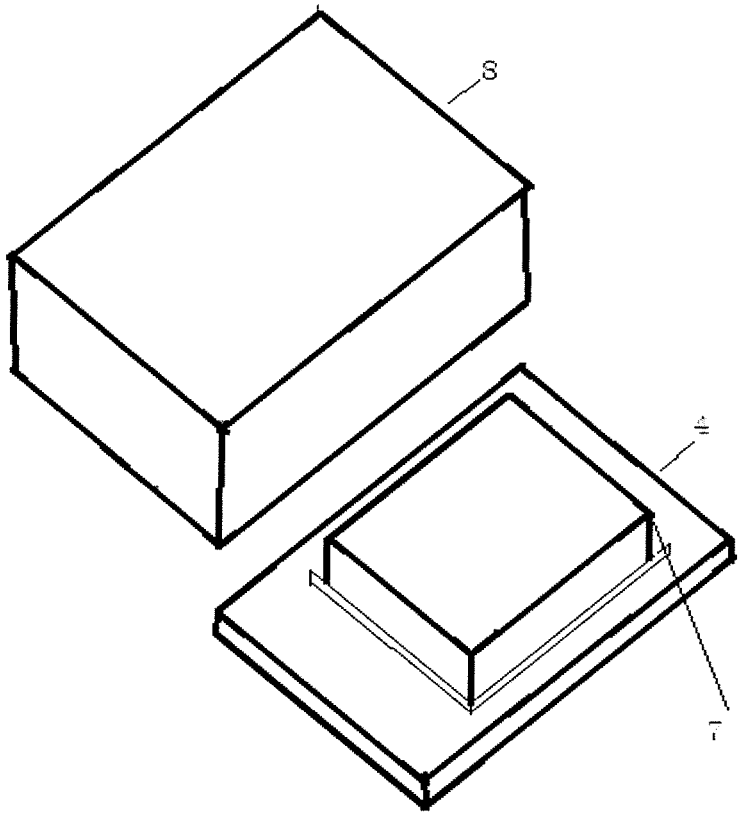
FIG. 3 is a schematic view of a perspective structure of a second embodiment of the present invention.

Referring to FIG. 2 and FIG. 3, a microphone with a mechanical switch function in a second embodiment has the same interior structure as the first embodiment. A microphone with a mechanical switch function comprises a circuit substrate 4, a metal cover 7 disposed on the circuit substrate 4, and an elastic metal cover 8 arranged on the outside of metal cover 7. Dimensions for all the components involved in the present invention are as follows: the length of the circuit substrate 4 is set to 3.5 mm, the width thereof is set to 2.65 mm, and the height thereof is set to 0.25 mm; the length of the metal cover 7 is set to 2.2 mm, the width thereof is set to 1.3 mm, and the height thereof is set to 0.75 mm; the length of the elastic metal cover 8 is set to 3.3 mm, the width thereof is set to 2.4 mm, and the height thereof is set to 0.9 mm; the width of the metal cover 7 is spaced apart from the width of the circuit substrate 4 by 0.65 mm, and the length of the metal cover 7 is spaced apart from the length of the circuit substrate 4 by 0.675 mm. As a preferred embodiment of the present invention, an elastic metal cover 8 is disposed outside of the conventional MEMS microphone metal cover 7, wherein the elastic metal cover 8 completely covers the outer of the metal cover 7; the elastic metal cover 8 is mounted on the circuit substrate 4, an enclosed space is formed by the elastic metal cover 8 and the circuit substrate 4; the width of the elastic metal cover 8 is at a distance of 0.1 mm from the width of the circuit substrate 4, and the length of the elastic metal cover 8 is at a distance of 0.125 mm from the length of the circuit substrate 4. A lower acoustic through-hole is disposed on the circuit substrate 4, wherein the center of the acoustic through-hole is at a distance of 2.2 mm from the length of the circuit substrate, and is at a distance of 1.325 mm from the width of the circuit substrate. At least one surface of the elastic metal cover 8 is made of an elastic metal which functions as an elastic metal surface; the elastic metal surface has a thickness of 0.1 mm, and a gap is formed between the elastic metal surface and the metal cover 7; the gap is in the range of 0.03 to 0.07 mm, and is 0.05 mm in this embodiment. When subjected to an external force, the metal elastic surface of the elastic metal cover 8 electrically contacts the metal cover 7 to cause short circuit, hence switching on and off is achieved.

Switch-on and Switch-off actions are achieved by means of the metal elastic piece. The microphone has two layers of metal shells, an inner metal shell is rigid, and an outer metal shell is a metal elastic piece or the metal cover which has certain elasticity. When subjected to the external force, the metal elastic piece or the metal cover will deform and contact with the inner metal shell to cause short circuit. When the force exerted on the metal elastic piece or the metal cover disappears, the metal elastic piece is loosened, and switch-off is achieved, thereby, turning off the device. It should be understood that such a structure has advantages of thinner product, simple structure, strong stability and small occupancy. Moreover, it is low in cost, such that it may be produced for a wide range of applications. In addition, the combination of the switch with the electronic device function and the microphone function saves a lot of space. Such a structure may be applied to all the electronic devices with a switch, such as driven-by-wire headphones, wireless and bluetooth headsets.

The above descriptions are only the preferred embodiments of the invention, not thus limiting the embodiments and scope of the invention. Those skilled in the art should be able to realize that the schemes obtained from the content of specification and drawings of the invention are within the scope of the invention.

What is claimed is:

1. A microphone with a mechanical switch function, comprising:

a microphone body, wherein the microphone body comprises a circuit substrate above which a metal cover is disposed, an acoustic cavity formed by the metal cover and the circuit substrate; and further comprising: a metal elastic piece, wherein a gap is formed between the metal elastic piece and the metal cover, and the metal elastic piece electrically contacts with the metal cover under an effect of a pressing force.

2. The microphone with a mechanical switch function of claim 1, wherein:

a metal cover cap is sleeved outside of the metal cover, and at least one surface of the metal cover cap is made of an elastic material which functions as the metal elastic piece.

3. The microphone with a mechanical switch function of claim 1, wherein:

the metal elastic piece comprises an arc-shaped surface, a concave face of the arc-shaped surface is arranged to face the metal cover, to form the gap.

4. The microphone with a mechanical switch function of claim 1, wherein:

an acoustic through-hole is disposed on the circuit substrate.

5. The microphone with a mechanical switch function of claim 1, wherein:

the metal elastic piece comprises a mounting portion that is insulated from the metal cover cap.

6. The microphone with a mechanical switch function of claim 5, further comprising:

a mounting frame, wherein a buckle is disposed on a top of the mounting frame, a mounting portion of the metal elastic piece is provided with a connection portion fitting with the buckle, and the mounting frame is arranged on the circuit substrate.

7. The microphone with a mechanical switch function of claim 1, wherein:

the metal elastic piece is an elastic metal cover, and at least one surface of the metal elastic piece is made of an elastic material which functions as an elastic metal surface.

8. The microphone with a mechanical switch function of claim 7, wherein:

the gap is formed between the elastic metal surface of the elastic metal cover and the metal cover, and the gap is in the range of 0.03 to 0.07 mm.

9. The microphone with a mechanical switch function of claim 7, wherein:

the elastic metal cover is mounted on the circuit substrate, and an enclosed space is formed by the elastic metal cover and the circuit substrate.

* * * * *